United States Patent [19]

Friedman et al.

[11] Patent Number: 4,566,721

[45] Date of Patent: Jan. 28, 1986

[54] FOLDER WITH REWRITABLE SURFACE FOR CHECKBOOKS AND THE LIKE

[75] Inventors: Harvey W. Friedman, Longmeadow; Jerry L. Kohli, Feeding Hills, both of Mass.; Cynthia L. DeMur, Enfield, Conn.

[73] Assignee: Buxton, Inc., Agawam, Mass.

[21] Appl. No.: 578,553

[22] Filed: Feb. 9, 1984

[51] Int. Cl.[4] ..... B42D 3/00; B42D 3/02; B42D 3/12

[52] U.S. Cl. ..... 281/31; 281/29; 281/30

[58] Field of Search ..... 281/29, 30, 31; 156/292; 150/35, 38

[56] References Cited

U.S. PATENT DOCUMENTS

| | | | |
|---|---|---|---|
| 1,802,794 | 4/1931 | Trussel | 156/292 |
| 2,303,248 | 11/1942 | Allen | 281/31 |
| 2,737,220 | 3/1956 | Hoff | 281/31 |
| 2,788,041 | 4/1957 | Carver | 281/29 |
| 3,161,216 | 12/1964 | Sloves | 281/31 |
| 3,267,841 | 8/1966 | Metcalf | 281/31 |
| 3,267,980 | 8/1966 | Bird | 281/31 |
| 4,296,945 | 10/1981 | Pavlik | 281/31 |

*Primary Examiner*—Paul A. Bell
*Assistant Examiner*—Paul M. Heyrana, Sr.
*Attorney, Agent, or Firm*—Chapin, Neal & Dempsey

[57] ABSTRACT

A checkbook folder of integral three-ply construction includes a transverse hinge separating front and back cover panels. The folder is formed by an outer, transparent, rectangular sheet and two smaller, rectangular, inner sheets of synthetic plastic material each being superimposed in edge-to-edge relation with opposite edge portions of the outer sheet and the sheets are bonded together along their peripheral edges. Each cover panel includes a pocket having an opening facing toward the hinge of the folder. An opaque, unitary fibrous insert, imprinted on at least its outer surface, is disposed within the pockets and includes a fold line which corresponds to the transverse hinge.

1 Claim, 4 Drawing Figures

Fig. 1.
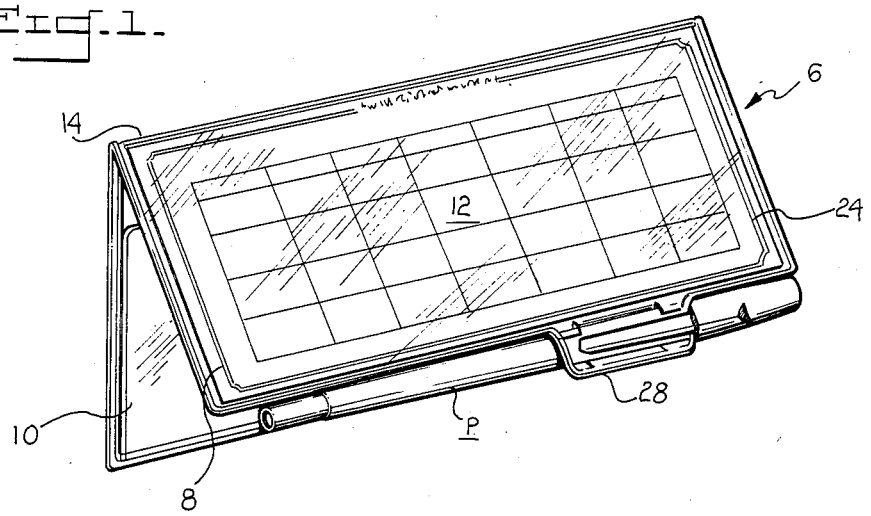
Fig. 2.
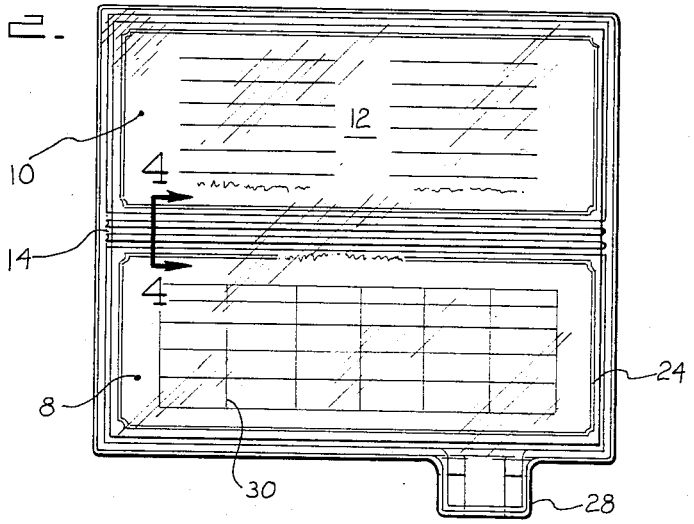
Fig. 3.
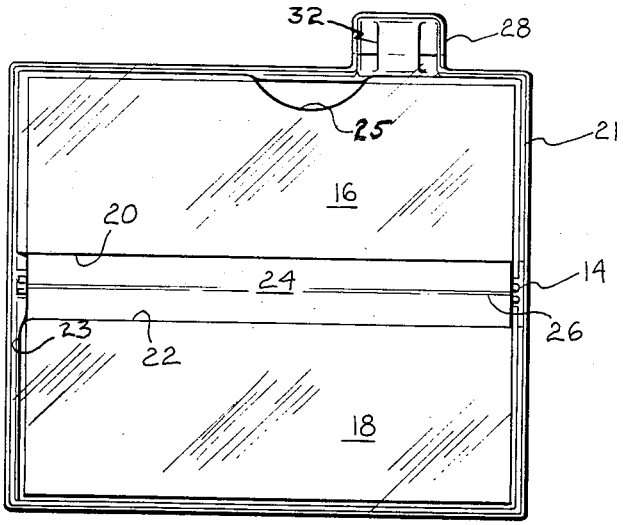
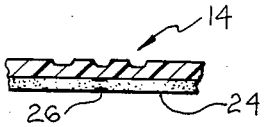
Fig. 4.

FOLDER WITH REWRITABLE SURFACE FOR CHECKBOOKS AND THE LIKE

BACKGROUND OF THE INVENTION

There are a number of prior patents which show various types of game boards and similar devices having rewritable surfaces which are readily erasable. Examples of such patents include U.S. Pat. Nos. 255,892; 2,112,762 and 3,618,231. U.S. Pat. No. 3,763,995 discloses a "matchbook cover" having a carbon paper insert and U.S. Pat. No. 3,922,457 relates to an erasable composition per se.

In addition to the above prior art, the Rock U.S. Pat. No. 2,909,202 discloses a combination wallet and calendar formed of a single ply of heavy paper or lightweight paper board or plastic. One surface of the sheet is said to be processed so that written notes may be readily erased when desired. This disclosure would apply to a surface adapted for pencil notations which are erasable by a conventional gum type eraser. In general, it will be seen that none of these prior patents discloses a folder for a checkbook and the like which comprises the combination of a transparent two-ply outer pocket bearing sheet material and an imprinted opaque sheet disposed therein and significantly wherein the outer sheet is a synthetic plastic material adapted to be ink receptive by a felt-tip pen and readily erased or wiped clean by using a commonplace tissue.

The principal object of this invention is to provide a folder for a checkbook and the like of simple and economical construction in which at least one of the surfaces of the folder is adapted to be receptive to notations written by a felt-tip type pen and in which the ink can be wiped away by a tissue paper or the like.

It is another object of this invention to provide a folder for a checkbook and the like which is formed by a two-ply transparent plastic sheet material with an opaque insert disposed therebetween.

It is a further object of this invention to provide a folder for a checkbook and the like of the above type in which the opaque insert is a fibrous sheet imprinted with indica for use as an aid in recording various memoranda and diary type information.

The above and other objects and advantages of this invention will be more readily apparent from the following description read in conjunction with the drawings in which:

FIG. 1 is a perspective view of a checkbook folder of the type embodying this invention;

FIG. 2 is an overall plan view showing the outer surface of the checkbook folder;

FIG. 3 is a plan view similar to FIG. 2 showing the inner surface of the checkbook folder, and FIG. 4 is a section taken along line 4—4 of FIG. 2.

Referring in detail to the drawing in FIG. 1, a folder for a checkbook and the like is shown generally at 6. The folder comprises a first cover panel 8 and a second cover panel 10. A transverse hinge line 14 extends over the full width of the folder and separates or defines the inner edges of the two cover panels.

The folder 6 is formed by a first generally rectangular outer sheet 12 of any suitable synthetic plastic material and two inner, rectangular sheets 16 and 18 of similar plastic material, each of which is slightly less than one-half the size of the outer sheet 12. The inner sheets 16 and 18 are superimposed in edge-to-edge relation with opposite edge portions of the outer sheet 12 and the three sheets are bonded together, such as by heat-sealing along their peripheral outer edges, as indicated at 21. The inner, transverse edges of the smaller sheets 16 and 18 are left open, thereby providing access to pocket 20 in the back cover panel 16 and pocket 22 in the front cover panel 18. In addition, edge 23 of sheet 18 is preferably left unsealed for providing easier access to the pocket 22. The back cover panel of any conventional type of checkbook (not shown) may be inserted into pocket 20 whereby the folder serves as a holder for the checkbook and the other pocket 22 may be used for storage of various loose memoranda sheets, deposit slips and the like.

The outer sheet 12 and/or the inner sheets 16 and 18 may be made of any suitable synthetic plastic which is a flexible transparent material having an ink receptive or oleophilic property so that it can be written upon by a felt-tip pen. One such material is a polypropylene copolymer. The material selected should also be one from which the ink can be readily expunged or erased by the simple step of wiping a tissue over the ink imprinted surface.

An opaque insert 24, best shown in FIGS. 3 and 4, is disposed between the outer plastic sheet 12 and the inner sheets 16 and 18. Insert 24 may be a sheet of fibrous material, such as craft paper having a score or fold line 26 which extends transversely across its center for easy folding thereof. The paper sheet is preferably treated or impregnated with a suitable composition so that it will be tear-resistant despite repeated folding and unfolding crease line 26. The opaque fibrous sheet 24 is of generally rectangular configuration and is made slightly smaller than the outer sheet 12 so that its outer edge portions can be readily fitted into the pockets 20 and 22 of the folder, as shown in FIG. 3. With the insert in place, the folder 6 comprises a flat, three-ply construction except along the fold or hinge line where it is of two-ply construction for easy folding and unfolding. Even though the folder is of three-ply construction, the materials used are relatively thin and thus the folder is thin in cross-section, compact, lightweight and easy to use.

As best seen in FIG. 4, the hinge line 14 of the outer plastic sheet 12 comprises a plurality of spaced parallel ribs or lands and grooves which extend over the full width of the folder. The score line 26 of the fibrous insert sheet 24 is located to register with the hinge line 14 of the outer sheet 12 so as to enable easy opening and closing of the folder for access to a checkbook carried within the folder. The peripheral edge seal of the outer sheet 12 and the inner sheets 16 and 18 is grooved in a manner similar to the hinge area to provide a stiffened edge of durable construction, but attractive in appearance. The attractiveness and functionality of the folder is further enhanced by suitable indicia imprinted on the outer surface of the insert. Preferably, it is imprinted with indica which may be in the form of a calendar 30 and memoranda lining for ease in organizing the written notations of the user.

The folder embodying this invention would normally be used in combination with a conventional checkbook by simply inserting the back cover of the checkbook would be simply inserted into the back pocket 20 and the front cover panel 10 folded thereover. This makes for a thin, lightweight and attractive checkbook holder. A small semi-circular flap 25 is cut in the outer edge of sheet 16 to assist in fitting the checkbook cover into the pocket 20. The folder also includes a tab 28 or extension adapted to receive and hold the barrel of a felt-tip pen, as illustrated at p in FIG. 1 of the type which is adapted for writing on the oleophilic surface of the plastic sheet material of which the folder is formed. The tab comprises a rectangular flange extension formed along the edge of outer sheet 12. A narrower flange 32 extends from the outer edge of sheet 16 is sealed at its inner and outer edges to provide a pen holding loop, as illustrated in FIG. 1.

Having thus described my invention, what is claimed is:

1. Folder for checkbooks and the like comprising a generally rectangular outer ply of transparent, synthetic plastic sheet material, said outer ply having a transversely extending hinge line defined by a plurality of spaced, parallel lands and grooves at approximately its center, at least two pocket-forming inner plies of synthetic plastic sheet material, each disposed in superposed edge-to-edge relation with opposite edge portions of the outer ply and bonded along at least two peripheral edges thereof to the corresponding edges of the outer ply, each of said inner plies having a free inner edge parallel to and on opposite sides of said hinge line to provide access openings into pockets formed between the inner and outer plies and an opaque insert disposed between said outer and inner plies and having indicia imprinted thereon on at least one side, said insert being a unitary rectangular sheet having a transverse fold line which is disposed to register with said hinge line of the outer ply, said insert being slightly smaller than the outer ply of said folder and being formed of a fibrous material treated to be tear resistant despite repeated folding and unfolding along said fold line thereof, said insert being inserted within said pockets such that said indicia are visible when viewed through said outer ply, said synthetic plastic material being receptive to ink applied thereto by a felt-tip pen and being adapted to be wiped clean by a tissue or the like, said folder including as an integral extension thereof, a pen holding tab.

* * * * *